United States Patent [19]

Galumbeck

[11] Patent Number: 4,677,701

[45] Date of Patent: Jul. 7, 1987

[54] FIRMNESS CONTROL DEVICE

[76] Inventor: Michael H. Galumbeck, 5577 Vantage Point Rd., Columbia, Md. 21044

[21] Appl. No.: 799,647

[22] Filed: Nov. 19, 1985

[51] Int. Cl.[4] ..... A47C 23/04; A47C 27/04

[52] U.S. Cl. ..... 5/447; 5/464

[58] Field of Search ..... 5/447, 446, 464, 1; 297/284

[56] References Cited

U.S. PATENT DOCUMENTS

| | | | |
|---|---|---|---|
| 1,088,305 | 2/1914 | Treiber | 5/446 |
| 3,252,170 | 5/1966 | Frye | 5/447 |
| 3,551,924 | 1/1971 | Frye, Sr. | 5/447 |
| 3,739,409 | 6/1973 | Johnson | 5/447 |
| 4,222,137 | 9/1980 | Usami | 5/446 |

*Primary Examiner*—Alexander Grosz

*Attorney, Agent, or Firm*—Bacon & Thomas

[57] ABSTRACT

A device for varying the firmness of a body supporting foundation, such as a box spring of a bed assembly or the like, including a vertically movable platform provided with a plurality of spaced resilient cushion members that may be selectively positioned at different distances from the upper support surface of the foundation for modifying the degree of deflection of the support surface without affecting the inherent resiliency of the individual springs.

9 Claims, 8 Drawing Figures

FIRMNESS CONTROL DEVICE

BACKGROUND OF THE INVENTION

1. Field of the Invention

The present invention generally involves the field of technology pertaining to resilient foundations, such as beds, chaise lounge cushions or the like, specifically designed for supporting the human body in a prone position of sleep or rest. More specifically, the invention relates to an improved device for varying the firmness of a resilient foundation, particularly a box spring on which a mattress may be disposed for defining a bed assembly.

2. Description of the Prior Art

A conventional bed assembly is basically defined by a foundation on which an overlying mattress is supported. The foundation may comprise a rigid frame assembly which, in combination with a resilient mattress, forms what is known in the industry as a platform bed. More traditionally, the foundation is provided with a plurality of spaced internal coil springs which afford a certain degree of resilient support for the overlying mattress. The firmness experienced by the user in traditional beds must necessarily be limited to the inherent firmness of the mattress and foundation. This situation constrains the user to an established degree of firmness which can only be varied by substituting the existing mattress or foundation with another having the desired firmness. Another problem arises in those situations wherein a couple share the same bed and, because of different body weights or different firmness preferences, it is often necessary for the couple to compromise their individual comfort needs.

The prior art has recognized the aforediscussed problems associated with conventional bed structures and has attempted to overcome these problems by providing various approaches through which the firmness of either the foundation or mattress may be selectively varied. These proposals basically involve mechanisms for varying the inherent resiliency of the existing resilient support structure of the foundation or mattress. For example, it is well known to compress the individual coil springs of a foundation in order to limit their degree of compression, thereby modifying the inherent resiliency of the springs. Examples of this and other similar forms of known firmness control mechanisms are disclosed by the Robell U.S. Pat. No. 2,504,352, Backus U.S. Pat. No. 2,558,288, Bloom U.S. Pat. No. 2,985,895, Cunningham U.S. Pat. No. 3,166,768, Frye U.S. Pat. No. 3,252,170, Frye U.S. Pat. No. 3,551,924, Sproll U.S. Pat. No. 3,553,745, Johnson U.S. Pat. No. 3,739,409, and Usami U.S. Pat. No. 4,222,137.

SUMMARY OF THE INVENTION

It is an object of the present invention to provide an improved device for controlling and varying the firmness of a resilient foundation for supporting the human body in a position of sleep or rest.

It is another object of the invention to provide a firmness control device for use in conjunction with a foundation provided with an internal resilient support structure, wherein operation of the device does not affect the inherent resiliency of the support structure.

It is a further object of the invention to provide an improved device for modifying the firmness of a bed assembly defined by a box spring foundation and a mattress.

It is yet another object of the invention to provide a firmness control device which may be utilized to independently vary the firmness of different areas of a mattress foundation.

These and other objects of the invention are realized by a firmness control device which comprises a platform supported for vertical movement on the underside of a resilient foundation. The upper surface of the platform is provided with a plurality of spaced resilient cushions, preferably formed of plastic foam material, with the individual cushions being positioned between the coil springs or other equivalent resilient members defining the internal support structure of the foundation. The platform may be raised and lowered by the user through rotation of a manually operated knob which is operatively connected to a threaded rod by means of a gear assembly. The threaded rod is in threaded engagement with a sleeve, whereby rotation of the threaded rod imparts linear movement to the sleeve, which in turn causes the platform to be raised and lowered through pivotal linkages connecting the sleeve to the platform. The vertical movement of the platform serves to position the upper ends of the cushions in any desired distance from the support surface of the foundation, thereby establishing the maximum degree of deflection for the support surface. The firmness of the foundation is therefore varied by modifying the degree of deflection and not by altering the inherent resiliency of the existing internal support structure of the foundation. In a preferred embodiment, a firmness control device in accordance with the invention may be disposed on each side of a box spring foundation, thereby permitting the firmness of the bed to be varied in accordance with the individual preferences of two individuals.

Other objects, features and advantages of the invention shall become apparent from the following detailed description of preferred embodiments thereof, with reference being made to the accompanying drawings wherein like reference characters refer to corresponding parts in the several views.

DETAILED DESCRIPTION OF THE PREFERRED EMBODIMENTS

Figure 1:
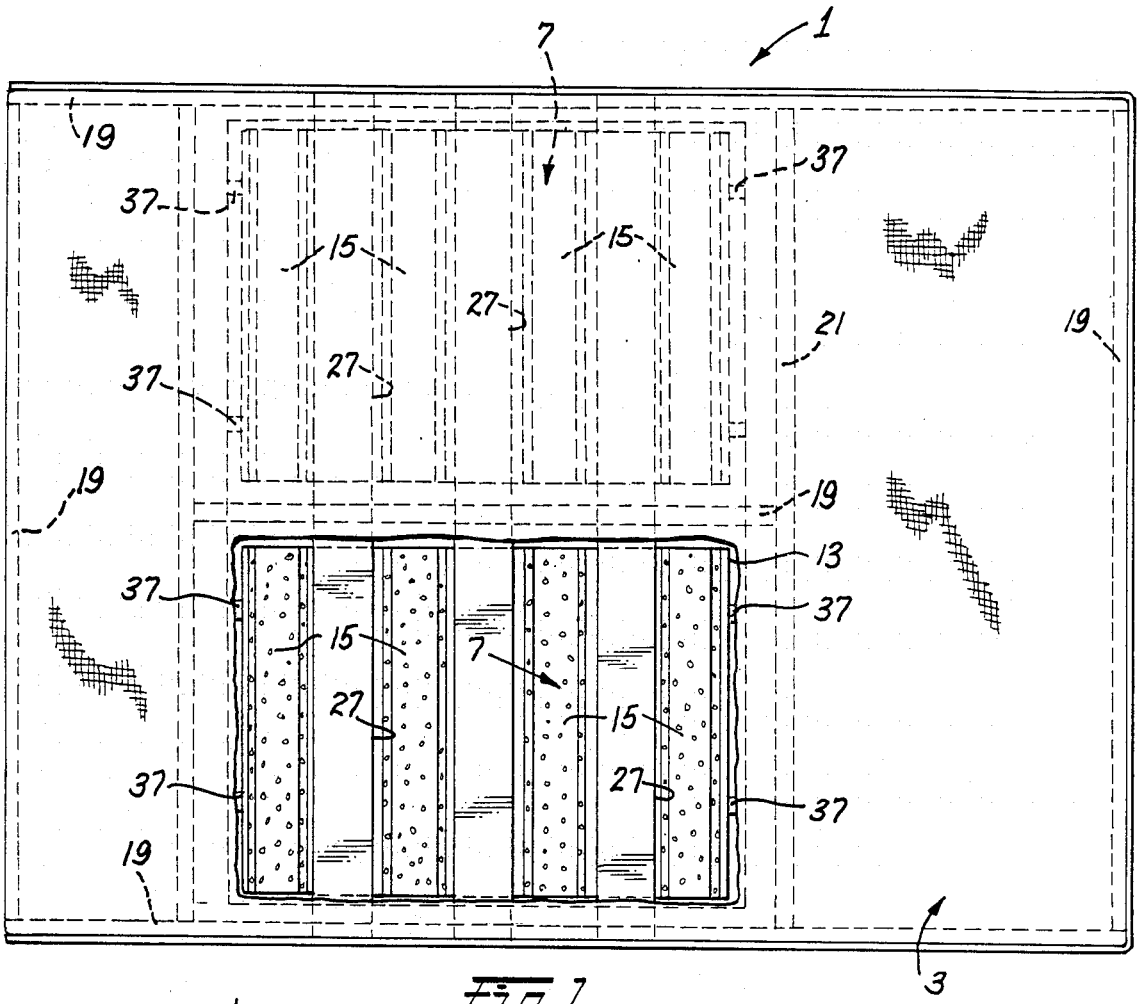
FIG. 1 is a plan view of a firmness control device according to a preferred embodiment of the invention shown with two such devices incorporated within a box spring foundation on which a mattress is supported to permit independent variation of the firmness of both sides of the bed, with a portion broken away for purpose of illustration.
Figure 2:
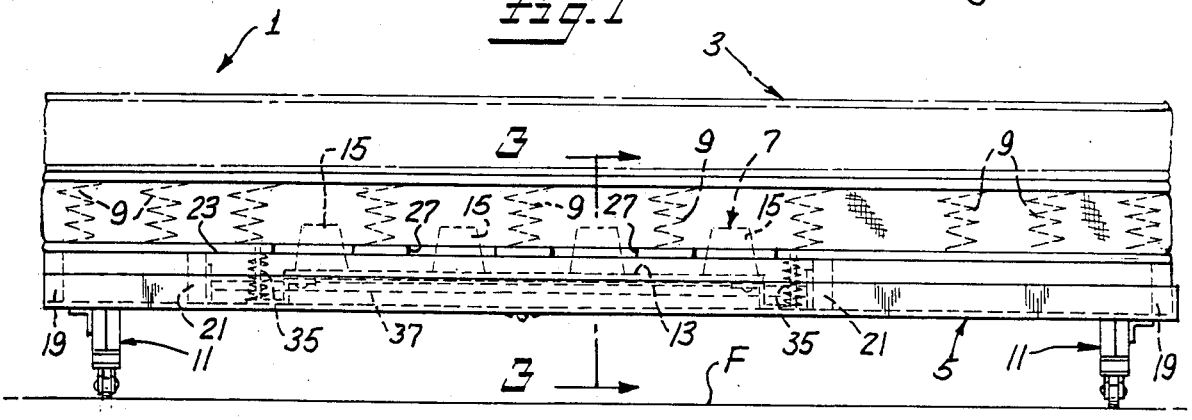
FIG. 2 is a side elevational view of the mattress and box spring foundation of FIG. 1.

As shown in FIGS. 1 and 2, a bed 1 is defined by a mattress 3 supported on a foundation 5 such as a box spring or the like, provided with a resilient internal support structure. A firmness control device 7, in accordance with a preferred embodiment of the invention, is incorporated on each side of foundation 5 and extends longitudinally thereof. Each device 7 is supported on the underside of foundation 5 and positioned directly beneath the area of bed 1 on which an individual is intended to be supported for sleep or rest. Foundation 5 is preferably of the type having an internal resilient support structure defined by a plurality of spaced coil springs 9 or similar resilient members. Foundation 5 may also be provided with a plurality of conventional caster assemblies 11 for the purpose of providing the desired degree of vertical elevation for bed 1 and permitting same to be easily moved across floor F.

Bed 1 is shown to be of such size so as to accommodate two individuals on either side thereof. The incorporation of a pair of firmness control devices 7 therefore permits each individual to realize a different desired degree of firmness. However, it is to be understood that a smaller bed may only require a single device 7, and that any number of devices 7 may actually be utilized to accommodate the size and firmness control requirements of a given bed. Moreover, device 7 may also be utilized in any type of foundation structure other than a bed foundation, for example, resilient chaise lounge cushions or other similar foundations for supporting a human body in a position of sleep or rest wherein it is desired to modify the degree of firmness desired by the individual.

Figure 3:
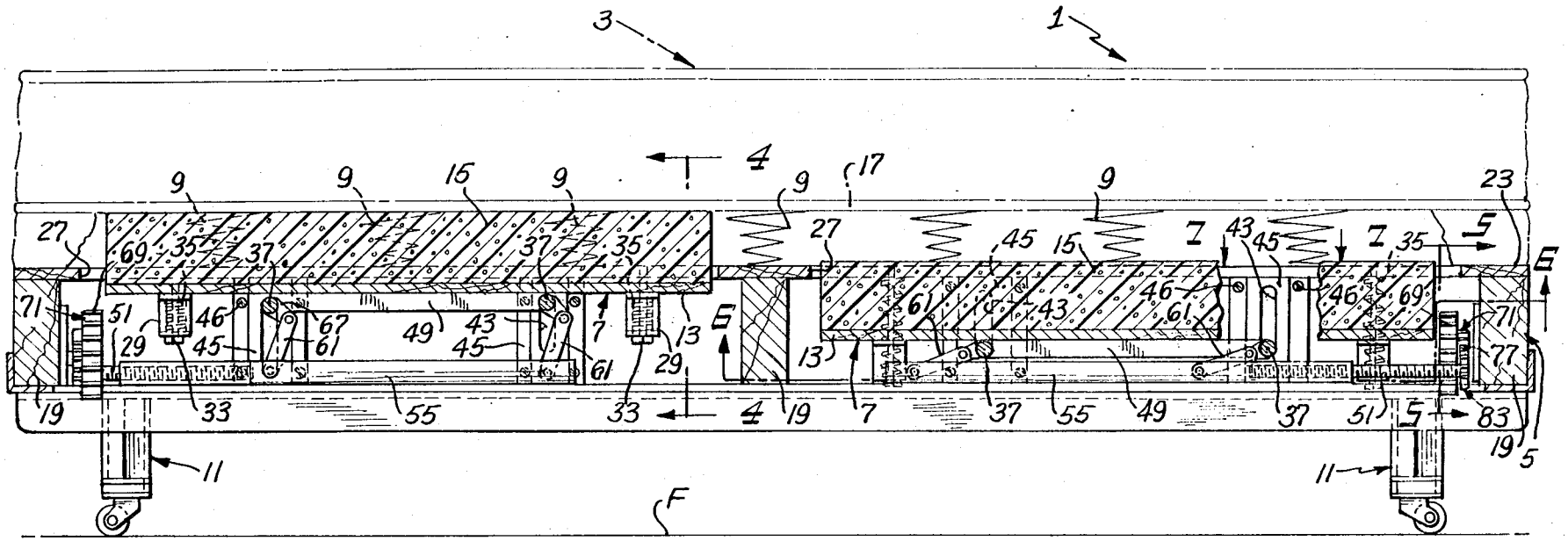
FIG. 3 is an enlarged transverse vertical sectional view, taken on the line 3—3 of FIG. 2.
Figure 4:
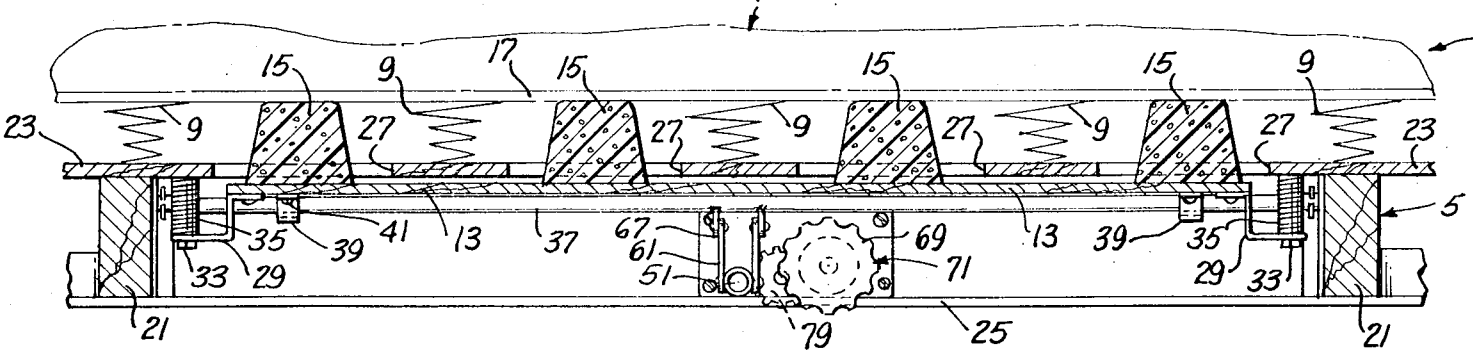
FIG. 4 is a fragmentary longitudinal vertical sectional view, taken on the line 4—4 of FIG. 3.

The details of firmness control device 7 shall now be described with particular reference to FIGS. 3 and 4. As seen in FIG. 3, device 7 at the lefthand side of the figure is disposed in its uppermost vertical position, while device 7 at the righthand side of the figure is disposed in its lowermost vertical position. Each device 7 includes a platform 13 on which a plurality of elongate resilient cushions 15 are supported. Cushions 15 are preferably formed from a suitable plastic foam material, such as polyurethane or the like, having the resiliency and structural strength required for the practice of the invention as disclosed herein. As seen in FIG. 4, cushions 15 are spaced on platform 13 so as to be interdisposed between coil springs 9 of foundation 5. In this way, vertical movement of cushions 15 are independent of springs 9 and do not affect their inherent resiliency. However, the vertical position of cushions 15 do serve to modify the maximum deflection of a top surface 17, defined primarily by a wire grid or the like, of foundation 5. This deflection control of support surface 17 therefore serves to provide the desired degree of firmness of foundation 5 and mattress 3 supported thereon. Though each cushion 15 is depicted as being of an elongate configuration and having a substantially truncated transverse cross-sectional shape, it is understood that cushions 15 may each be of any other appropriate configuration deemed desirable for the practice of the invention. Furthermore, cushions 15 may also be in the form of springs or other similar resilient members well known in the art.

Foundation 5 may be of any known conventional structure. For purpose of illustration, foundation 5 is shown to be of a traditional box spring configuration including a plurality of longitudinal wood beams 19 secured to a plurality of transverse wood beams 21 which collectively define the supporting framework. The upper edges of beams 19 and 21 are secured to a top sheet 23, while the lower edges of beams 19 and 21 are secured to a bottom sheet 25, with both sheets 23 and 25 being preferably of wood. Top sheet 23 is provided with a plurality of rectangular-shaped openings 27 through which cushions 15 may be passed during their vertical travel towards and away from support surface 17.

Figure 5:
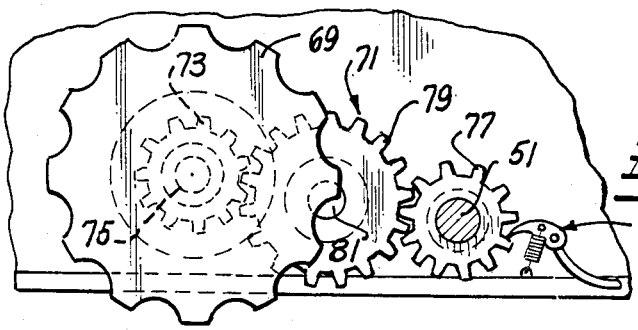
FIG. 5 is a vertical sectional view showing the gear assembly through which the firmness control device of the invention may be operated.
Figure 6:
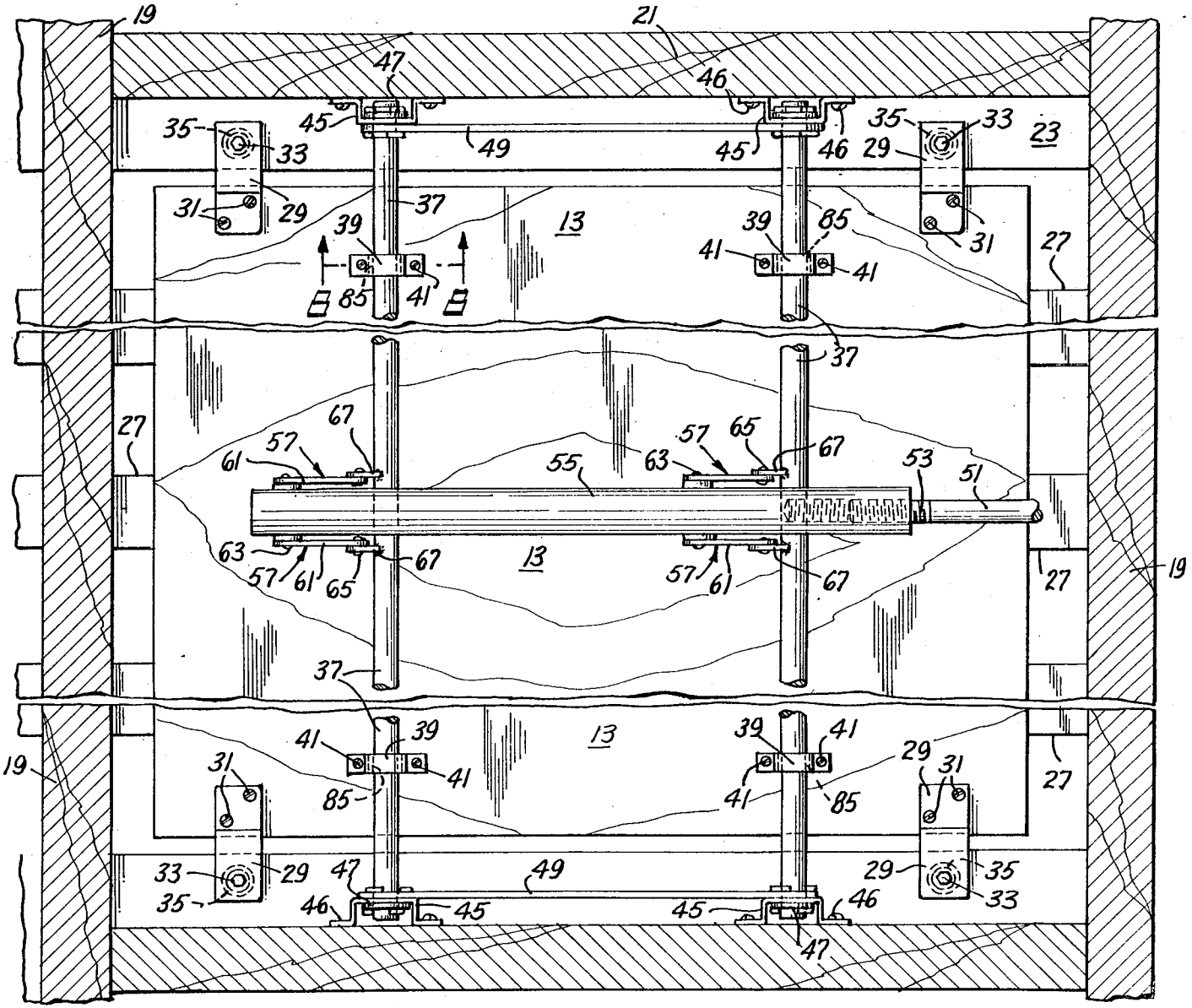
FIG. 6 is a partial underside view of a single firmness control device in accordance with the invention mounted within a box spring foundation.

The details of the mechanism through which platform 13 is raised and lowered shall now be described with further reference to FIGS. 5 and 6. Platform 13 is provided with a plurality of Z-shaped brackets 29, each of which has one leg thereof rigidly secured to the underside of platform 13 by a plurality of screws 31 or similar fasteners. The remaining leg of each bracket 29 is secured to the underside of sheet 23 by an elongate bolt 33 provided with a coil spring 35 therearound. As more clearly shown in FIG. 4, springs 35 are in their substantially fully compressed condition due to the fact that the upper ends of cushions 15 are disposed in their uppermost position adjacent support surface 17. Thus, the raising of platform 13 is accomplished against the force of springs 35.

Figure 7:
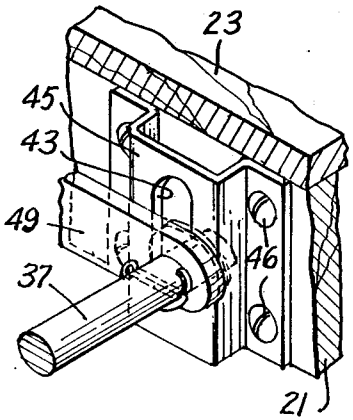
FIG. 7 is a perspective view showing the manner in which one end of a longitudinal actuating rod of the device is supported for vertical movement.

The stable positioning of platform 13 during its vertical movement is realized by providing platform 13 with a pair of spaced rods 37, each of which is rigidly secured to the underside of platform 13 by a pair of brackets 39 and screws 41 or similar fasteners. The outer ends of rods 37 are each disposed within an elongate slot 43 of a channel-shaped plate 45 which is secured to beam 21 by a plurality of screws 46 or similar fasteners. This is more clearly shown in FIG. 7 wherein it is apparent that rod 37 is afforded a degree of vertical movement equal to the extent of the overall height of slot 43. Each terminal end of rod 37 is locked within plate 45 by a lock washer 47 or other similar fastener. In order to assure joint vertical movement of rods 37 and also impart integral strength to the overall mechanism, the corresponding opposite ends of rods 37 are further secured together by an elongate strap 49.

The actuating device for raising and lowering platform 13 includes a shaft 51 having a threaded end 53 that is received within a correspondingly threaded end of a sleeve 55. Two pairs of double pivotal linkage assemblies 57 are secured to sleeve 55 and rods 37. Through this arrangement, linear movement of sleeve 55 in a direction perpendicular to rods 37 is translated into verticial movement of platform 13. The structural configuration of each linkage assembly 57 is conventional and well known in the art, and it is of course possible to vary such configurations so long as its required function of raising and lowering platform 13 can be realized. For illustration purpose, each linkage assembly 57 includes a main link 61 provided with a first pivot connection 63 to sleeve 55 and a second pivot connection 65 to a secondary link 67 that is rigidly secured to shaft 37, preferably through welding or the like.

The linear movement of sleeve 55 is controlled by a manually operated knob 69 which is conveniently disposed at the side of bed 1. With particular reference to FIG. 5, knob 69 is shown operatively connected to shaft 51 through a gear assembly 71 that may include a first gear 73 supported on a knob shaft 75, a second gear 77 supported on shaft 51, and a third gear 79 supported on a shaft 81. Third gear 79 is disposed between and in meshed engagement with gears 73 and 77, with all gears being secured for joint rotation with their associated shafts. A spring-biased locking pawl 83 is provided for engaging second gear 77 in order to maintain platform 13 in a desired position of elevation against the force of springs 35. Pawl 83 is manually releasable for permitting rotation of shaft 51 in the opposite direction when it is desired to lower platform 13. It is of course understood that gear assembly 71 may be substituted by any other appropriate gear configuration or mechanism which permits the corresponding rotation of shaft 51 through the manual rotation of knob 69. As apparent, shaft 51 is maintained stationary, but permitted to rotate by the rotation of knob 69 in both directions. Rotation of shaft 51 causes end 53 to be threaded into or out of sleeve 55, depending on the direction of rotation of shaft 51. This causes linear movement of sleeve 55 in opposite directions perpendicular to rods 37, thereby raising or lowering platform 13 through linkage assemblies 57.

Figure 8:
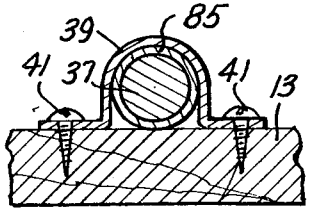
FIG. 8 is a vertical sectional view taken on the line 8—8 of FIG. 6.

As shown in FIG. 8, each shaft 37 may be provided with a bearing 85 disposed at each bracket 39 in order to facilitate rotation of shafts 37 within brackets 39 during movement of sleeve 55.

It is to be understood that the forms of the invention herein shown and described are to be taken as merely preferred embodiments of the same and that various changes in shape, material, size and arrangement of parts may be resorted to without departing from the spirit of the invention or scope of the subjoined claims.

I claim:

1. A variable firmness control device for a foundation defined in part by an upper support surface and an internal support structure for providing resiliency to the upper support surface, which device comprises:

(a) a platform for attachment to the underside of the foundation below the internal support structure;

(b) a plurality of spaced resilient members carried by the platform;

(c) means for moving the platform for simultaneously postioning the resilient members between portions of the internal support structure and at a desired distance from the upper support surface whereby the degree of deflection of the upper support surface is determined by the position of the resilient members independent of the internal support structure.

2. The device of claim 1 wherein each resilient member includes a cushion defined by an elongate body of plastic foam material.

3. The device of claim 1 wherein the internal support structure of the foundation includes a plurality of spaced coil springs and the spaced resilient members are positoned between the coil springs.

4. The device of claim 1 wherein the means for moving the platform includes:

(a) a sleeve supported for linear movement;

(b) a shaft supported for rotational movement;

(c) the sleeve and shaft being operatively connected whereby rotational movement of the shaft in either direction causes linear movement of the sleeve in a corresponding direction; and (d) pivotal linkage means connecting the sleeve to the platform wherein linear movement of the sleeve in either direction is translated into vertical movement of the platform in a corresponding direction.

5. The device of claim 4 further including:

(a) a pair of rods secured to the platform;

(b) the opposite ends of each rod being secured against the foundation for limited vertical movement; and (c) the pivotal linkage means is connected to the rods.

6. The device of claim 5 further including a channel-shaped bracket provided with an elongate slot for securing each end of the rods to the foundation, whereby vertical movement of the rods is limited to the height of the elongate slot.

7. The device of claim 6 further including means for connecting the spaced rods in order to assure joint vertical movement of same.

8. The device of claim 4 wherein rotation of the shaft is effected by a manually operated knob that is operatively connected to the shaft by a gear assembly.

9. The device of claim 8 wherein the gear assembly includes three gears and a releasable pawl for securing the gears against rotation.

* * * * *